US010077931B2

(12) United States Patent
Donnell et al.

(10) Patent No.: US 10,077,931 B2
(45) **Date of Patent: *Sep. 18, 2018**

(54) COOLER OR COOLER INSERT AND METHODS OF FABRICATION THEREOF

(71) Applicant: SO COOL PRODUCTS, LLC, Cobleskill, NY (US)

(72) Inventors: Gregory Donnell, Franklin, NY (US); Ted Krisowaty, Cobleskill, NY (US)

(73) Assignee: SO COOL PRODUCTS, LLC, Cobleskill, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/655,167

(22) Filed: Jul. 20, 2017

(65) Prior Publication Data

US 2017/0314836 A1 Nov. 2, 2017

Related U.S. Application Data

(63) Continuation-in-part of application No. 14/247,795, filed on Apr. 8, 2014, now Pat. No. 9,726,414.

(51) Int. Cl.
*F25D 3/08* (2006.01)
*F25D 21/14* (2006.01)

(52) U.S. Cl.
CPC ..... *F25D 3/08* (2013.01); *F25D 21/14* (2013.01); *F25D 2303/084* (2013.01); *F25D 2303/08222* (2013.01)

(58) Field of Classification Search
CPC ..... F25D 3/08; F25D 21/14; F25D 2303/084; F25D 2303/08222; F25D 19/003; F25D 11/00; F25D 3/00
See application file for complete search history.

(56) References Cited

U.S. PATENT DOCUMENTS

| | | | | |
|---|---|---|---|---|
| 2,496,296 | A | 2/1950 | Frederick | |
| 5,704,485 | A | 1/1998 | Cautereels et al. | |
| 6,364,329 | B1 * | 4/2002 | Holub | A45C 5/14 280/47.26 |
| 6,536,228 | B1 | 3/2003 | Hall | |
| 2005/0229625 | A1 * | 10/2005 | Donnell | F25D 3/08 62/457.2 |

* cited by examiner

*Primary Examiner* — Emmanuel Duke
(74) *Attorney, Agent, or Firm* — Schmeiser, Olsen & Watts, LLP

(57) ABSTRACT

An insert configured to be disposed in a receptacle, the insert comprising a bottom surface, a first top surface, a second top surface, the second top surface being located further from the bottom surface than the first top surface in a first direction, the first direction being orthogonal to the bottom surface, and a chamber, the chamber residing between the first top surface and the bottom surface and the second top surface and the bottom surface, the chamber being configured to hold a liquid, is provided. An associated method is also provided.

11 Claims, 11 Drawing Sheets

COOLER OR COOLER INSERT AND METHODS OF FABRICATION THEREOF

CROSS-REFERENCE TO RELATED APPLICATIONS

This application is a continuation-in-part of U.S. application Ser. No. 14/247,795, filed Apr. 8, 2014, and entitled "Cooler or Cooler Insert and Methods of Fabrication Thereof."

FIELD OF TECHNOLOGY

The following relates to embodiments of a cooling device, and more specifically to embodiments of an insert configured to be placed within a container, or a cooling device itself.

BACKGROUND

Coolers are generally used to keep items placed therein at a reduced temperature. Coolers are used by various segments of the population including campers, sporting event spectators/participants, laborers and medical personnel. Coolers have traditionally been used by placing loose ice in the cooler with any cooler contents. However, the use of loose ice in a cooler has a number of disadvantages, including: melt water generated from melting ice inside the cooler may come into contact with cooler contents rendering them unusable or undesirable; cooler contents may become buried under loose ice and melt water thereby becoming difficult to access; loose ice and/or melt water may settle at the bottom of the cooler creating an undesirable temperature gradient in the cooler; loose ice and melt water may become dirty after coming into contact with the cooler and/or cooler contents rendering it unsafe for consumption; and loose ice and melt water cannot be drained from the cooler without removing the cooler contents. Further, the ability of loose ice to keep cooler contents at an appropriate temperature over an extended period of time is limited.

Gel blocks may be used as a loose ice substitute as an alternative refrigeration source. Gel blocks generally include a cooling gel that is placed in a flexible or rigid container. The container is then placed in the cooler. Although gel blocks offer some advantages over loose ice, they present users with a number of disadvantages, including: gel blocks may frost over, which limits their ability to effect cooling; gel blocks accumulate condensation, which, like loose ice, creates unwanted moisture in the cooler that can render cooler contents unusable or undesirable; gel blocks often bulge and become distorted during the freezing process, which makes stacking difficult; gel blocks will generally settle on the bottom of the cooler during use which, like loose ice, creates a temperature gradient in the cooler; gel blocks may comprise toxic chemicals or chemicals that are undesirable for consumption; and gel blocks generally must be frozen overnight before use, which limits their ability to be recharged in the field.

The thermoelectric cooler is yet another alternative to loose ice. However, thermoelectric coolers require a constant power source, which substantially limits their portability and use. Further, thermoelectric coolers are generally more expensive than other types of coolers.

Thus, there is a need for an apparatus and method that addresses some or all of the above disadvantages.

SUMMARY

A first aspect relates to an insert configured to be disposed in a receptacle, the insert comprising a first portion having an opening for receiving contents, and a second portion connected to the first portion, the second portion having a cooling surface portion that is configured to extend across at least a portion of a bottom surface of the receptacle, wherein the contents received through the opening of the first portion are located within an interior of the insert to deliver refrigeration to an interior of the receptacle.

A second aspect relates to an insert configured to be disposed in a receptacle, the insert comprising a bottom surface, a first back surface, a first top surface, the first top surface having a cooling surface portion, a second top surface, the second top surface being further from the bottom surface than the first top surface in a first direction, the first direction being orthogonal to the bottom surface, a first front surface, the first front surface being located between the first top surface and the second top surface in the first direction, the first front surface having a cooling surface portion, and a chamber, the chamber being located between the first front surface and the first back surface and the first top surface and the bottom surface, the chamber being configured so that fluid therein does not contact contents placed within the receptacle while delivering refrigeration to the receptacle.

A third aspect relates to a cooling receptacle comprising, a first wall, a floor, the floor being fixed to the wall, a first top surface, the first top surface configured to extend along at least a portion of the floor, the first top surface being fixed to the receptacle, a first front surface, the first front surface configured to extend along at least a portion of the wall, the first front surface being fixed to the first wall, and a chamber, the chamber residing in between the first top surface and the floor and the first front surface and the first wall, the chamber being configured to hold a fluid such that fluid placed therein does not contact contents placed within the receptacle while delivering refrigeration to the receptacle.

BRIEF DESCRIPTION OF THE DRAWINGS

Some of the embodiments will be described in detail, with reference to the following figures, wherein like designations denote like members, wherein.

DETAILED DESCRIPTION

While this disclosure contains many specific details, it should be understood that various changes and modifications may be made without departing from the scope of the technology herein described. The scope of the technology shall in no way be construed as being limited to the number of constituting components, the concentration of constituting components, the materials thereof, the shapes thereof, the relative arrangement thereof, the temperature employed, the order of combination of constituents thereof, etc., and are disclosed simply as examples. The depictions and schemes shown herein are intended for illustrative purposes and shall in no way be construed as being limiting in the number of constituting components, connectivity, reaction steps, the materials thereof, the shapes thereof, the relative arrangement thereof, the order of reaction steps thereof, etc., and are disclosed simply as an aid for understanding.

As a preface to the detailed description, it should be noted that, as used in this specification and the appended claims, the singular forms "a," "an" and "the" include plural referents, unless the context clearly dictates otherwise.

Figure 1A:
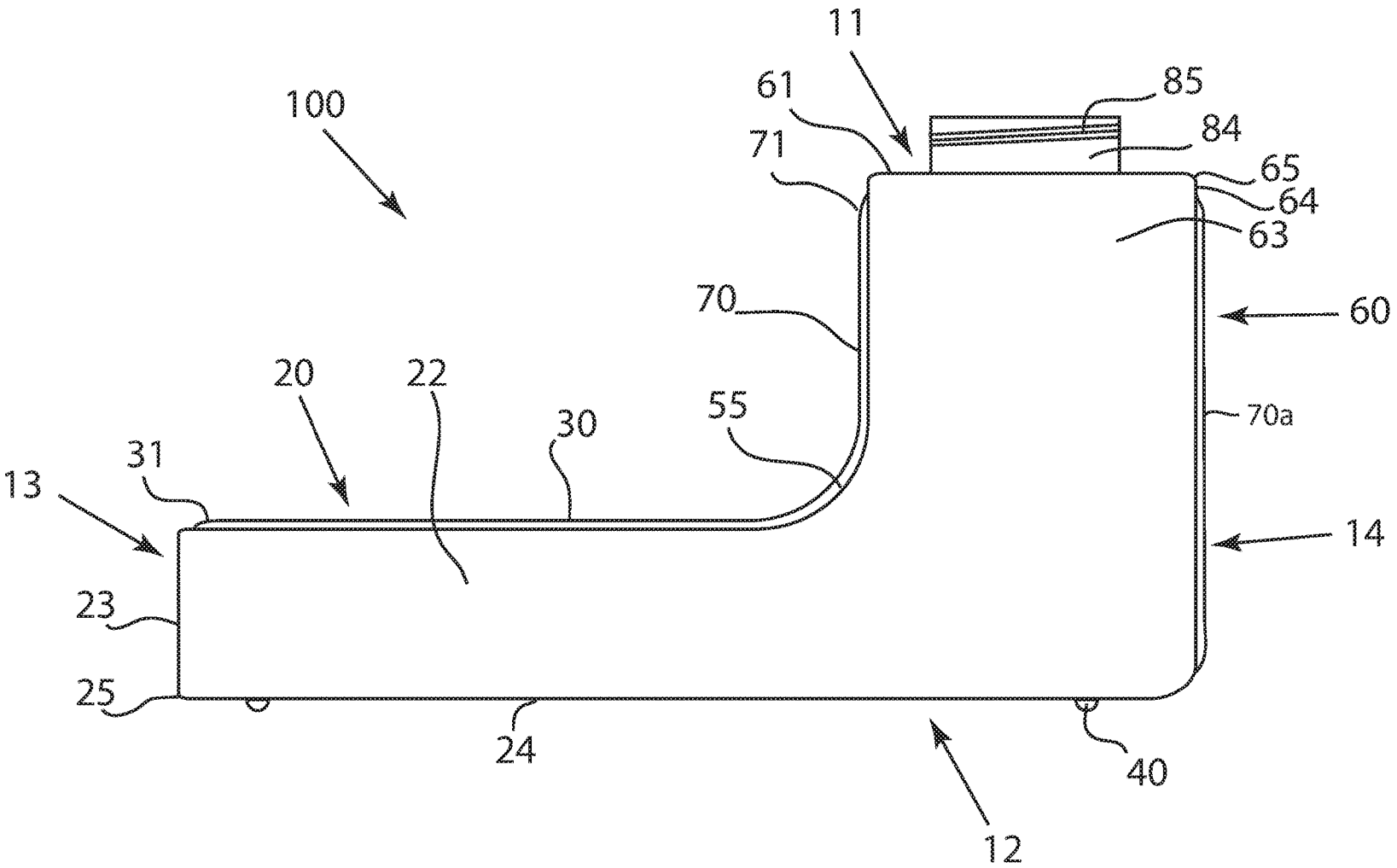
FIG. 1A depicts a side view of a first embodiment of a cooler insert.
Figure 1B:
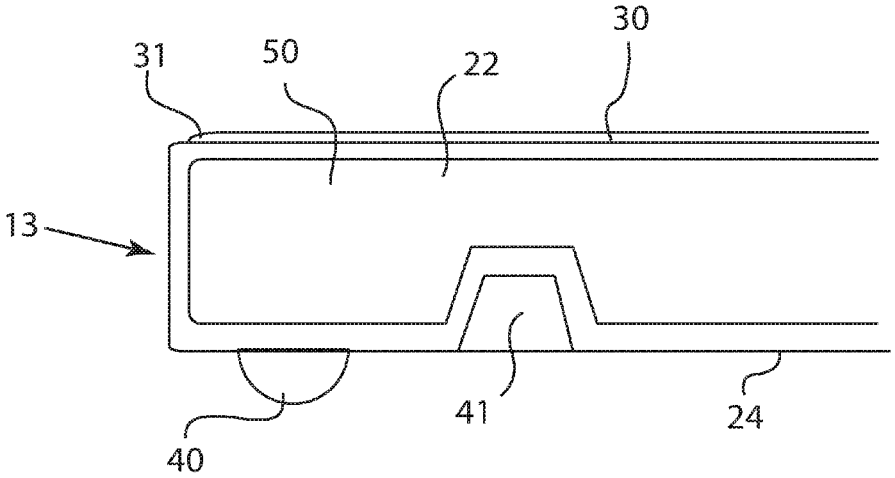
FIG. 1B depicts a detailed cross-sectional view of the side view of the first embodiment of the cooler insert.
Figure 1C:
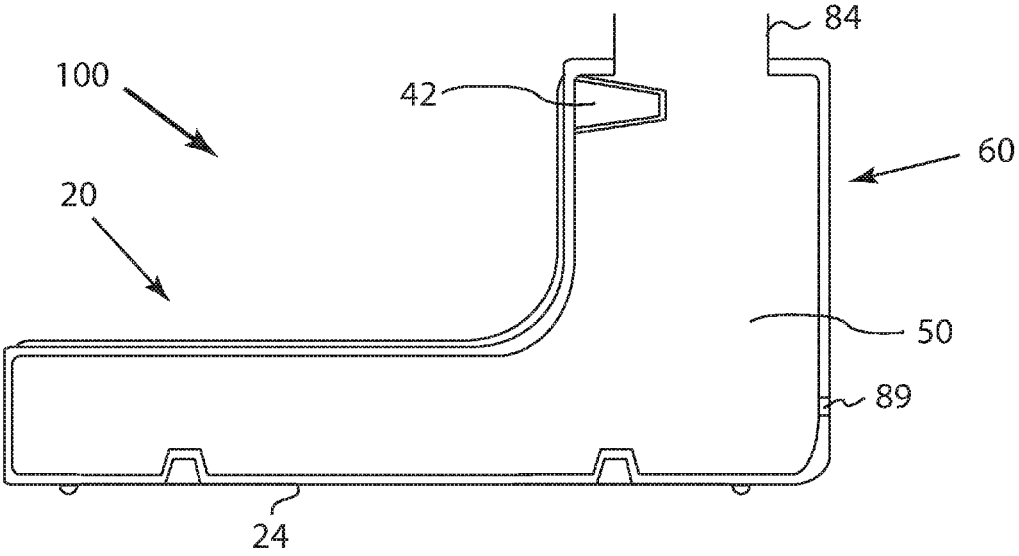
FIG. 1C depicts a cross-sectional view of the side view of the first embodiment of the cooler insert.

Referring to the drawings, FIGS. 1A-C depict a side view of an embodiment of insert 100. Embodiments of insert 100 may be configured to be disposed within a receptacle, such as a cooler or other container. Embodiments of the insert 100 may be a temperature regulator, a temperature regulator device, a temperature controller, a temperature controller device, a temperature management device, or any device that can affect or reduce a temperature within a receptacle, such as cooler or other container. Embodiments of insert 100 may include a first portion 60, a second portion 20 and a chamber 50. The first portion 60 may be connected to second portion 20 and may be configured to extend up therefrom. Chamber 50 may reside in first portion 60 and second portion 20. Chamber 50 may comprise a single cavity, internal volume or void, or multiple cavities, internal volumes or voids in fluid communication with one another. In some embodiments, chamber 50 is capable of holding a liquid.

In some embodiments, insert 100 may be manufactured in one piece, wherein the first portion 60 and the second portion 20 are structurally integral. In alternative embodiments, insert 100 may be manufactured in sections. Embodiments of insert 100 may be manufactured by continuous extrusion blow molding, intermittent extrusion blow molding, rotational molding or injection blow molding, or other methods known to those having skill in the art. Insert 100 may be made from plastics or other pliable materials, such as rubber or comparable materials, silicone, metal, metals, such as aluminum and stainless steel, etc., and/or a combination thereof. These materials may also be used in combination with one another by either permanently joining together or layering without fastening (removable), for example, fusing or layering fitted aluminum strips to the raised plastic ribs of the insert.

Referring now to FIGS. 1-5, embodiments of first portion 60 of insert 100 may include a first end 11, a top surface 61, front surface 62, side surface 63 and a back surface 64. In some embodiments, top surface 61, front surface 62, side surface 63 and back surface 64 may have curved edges 65. Additionally, in some embodiments, curved edges 65 may enhance the air circulation in the cooler. In some embodiments, curved edges may allow the insert to fit more securely in a cooler and/or allow easier insertion and removal of the insert 100 in and out of the cooler. In alternative embodiments, top surface 61, front surface 62, side surface 63 and back surface 64 may have beveled, chamfered or flat edges. Side surface 63 may be the same on both sides of the insert 100.

Embodiments of front surface 62 may include a plurality of projections 70. Projections 70 may extend along front surface 62 toward first end 11 and second end 12. Projections 70 may form continuous ribs with a half round shape. In alternative embodiments, projections 70 may have a triangular, chamfered, square or rectangular shape. And in further alternative embodiments, projections 70 may be segmented. Embodiments of projections 70 may include tapered ends 71 proximate the first end 11. Alternatively, projections 70 may have tapered ends proximate both ends or no tapered ends at all. In alternative embodiments, projections 70 may comprise pads. The pads may have a gumdrop, square, conical, circular, pentagon, hexagon, octagon or star shape. In further embodiments, projections 70 may comprise solid fins. Embodiments of the projections 70 may share a non-parallel arrangement with a floor of the cooler or other container, or a generally non-horizontal arrangement on the front surface 62. A non-parallel arrangement or non-horizontal arrangement of the projections may prevent, eliminate, reduce, and/or help prevent water or moisture from developing and accumulating. This may reduce the chance of mold formation on the insert 100 or within the container.

In additional embodiments, front surface 62 may comprise projections that extend inwardly (e.g. towards interior or insert 100) to form recessed channels or grooves. Alternatively, front surface 62 may comprise projections that extend inwardly to form recessed pads. The pads may have a gumdrop, square, triangular, circular, pentagon, hexagon, octagon or star shape. Projections on front surface 62 may allow cooler contents to come into contact with portions of the front surface 62 without being contaminated with liquid that may have formed on other portions of the front surface 62. Further, projections on front surface 62 may facilitate the circulation of air in the cooler, which can reduce the temperature gradient across the cooler.

Figure 1D:
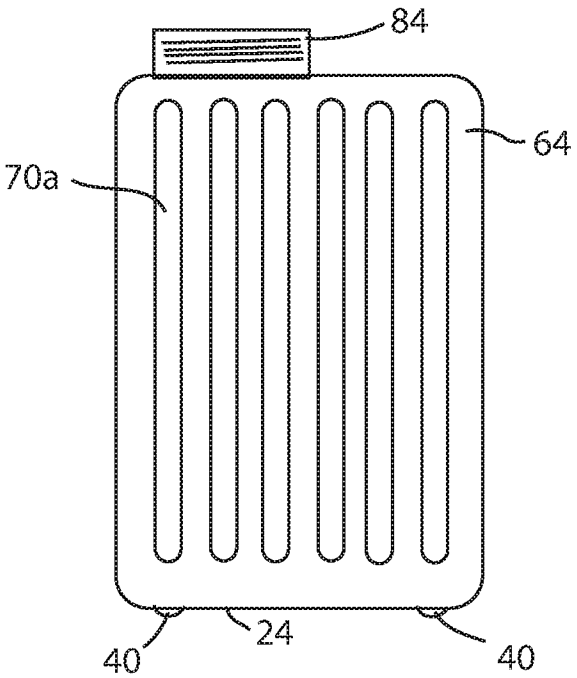
FIG. 1D depicts a rear view of the first embodiment of the cooler insert.

Referring now to FIG. 1D, embodiments of rear surface 64 may include a plurality of projections 70*a*. Projections 70*a* may extend along rear surface 64 proximate a bottom surface 24 toward the top surface 61. Projections 70*a* may form continuous ribs with a half round shape. In alternative embodiments, projections 70*a* may have a triangular, chamfered, square or rectangular shape. And in further alternative embodiments, projections 70*a* may be segmented. Embodiments of projections 70*a* may include tapered ends proximate the top surface 64. Alternatively, projections 70*a* may have tapered ends proximate both ends or no tapered ends at all. In alternative embodiments, projections 70*a* may comprise pads. The pads may have a gumdrop, square, conical, circular, pentagon, hexagon, octagon or star shape. In further embodiments, projections 70*a* may comprise solid fins. Embodiments of the projections 70*a* may share a non-parallel arrangement with the second portion 20 of the cooler or other container, or a generally non-horizontal arrangement on the rear surface 64. A non-parallel arrangement or non-horizontal arrangement of the projections may prevent, eliminate, reduce, and/or help prevent water or moisture from developing and accumulating. This may reduce the chance of mold formation on the insert 100 or within the container. Further, projections 70*a* on rear surface 64 may facilitate the circulation of air in the cooler, which can reduce the temperature gradient across the cooler, and promote a convection cycle of air.

Embodiments of the insert 100 may further include an inlet 84. Inlet 84 may form part of the first portion 60 of the insert 100. For instance, embodiments of the inlet 84 may be disposed on the top surface 61 of the insert 100. Inlet 84 may comprise threads 85 that are configured to receive a lid, wherein the lid includes threads that matingly correspond to the threads 85 on the inlet 84 to create a more secure connection between the lid and the inlet 84. In alternative embodiments, inlet 84 may be configured such that its circumference is substantially the same as a lid, allowing the lid to be placed thereover and held firmly in position. Alternatively, the lid may snap onto inlet 84. In yet another embodiment, the lid may share an interference fit with the inlet 84 to retain the lid, but not require rotation of the lid with respect to the inlet 84 for removal. Further embodiments may permanently attach a lid to the inlet 84 that may hinge from an open position to a closed position, so as to reduce the chance of losing or forgetting the lid.

Moreover, embodiments of inlet 84 may allow users to add or remove ice and/or water from chamber 50. Adding or removing ice and/or water may change a temperature within the chamber 50, and as a result, may change a temperature within an interior of the cooler. In alternative embodiments, access to the chamber 50 may be provided by partially or completely removing the top surface 61 from first portion 60. For example, the top surface 61 may be peeled back to create an opening to the chamber 50, and then laid back into a closed position. In some embodiments, top surface 61 may snap on and off of the first portion 60. Alternatively, top surface 61 may be hingedly connected to first portion 60 of the insert 100, thus allowing top surface 61 to be partially removed from first portion 60. Allowing top surface 61 to be partially or completely removable from first portion 60 may give users a larger area in which to add ice and/or liquid to chamber 50. In alternative embodiments, a portion of top surface 61 may be completely or partially removable. A partially or completely removable top surface 61 may also allow users to more easily access chamber 50, which may make cleaning insert 100 easier.

Embodiments of top surface 61 may include an opening 87 and a holder 88. Embodiments of the opening 87 may be an aperture, gap, hole, inlet, outlet, access point, and the like, that may be configured to accept or receive one or more tubes of a fluid outputting device. In other words, the opening 87 may allow the entry of a tube or other portion of the fluid outputting device into the chamber 50. Embodiments of the opening 87 may be in fluid communication with chamber 50, and may be configured to receive a flexible tube. Embodiments of a fluid outputting device may be a siphon, a condiment pump, siphon transfer pump, auto-siphon, siphon with primer bulb (squeeze siphon), battery operated pump, brass in-line shake style siphon and hand actuated bilge pump, and the like. Embodiments of the holder 88 may be configured to retain an end of a flexible tube placed through opening 87. For example, in some embodiments, holder 88 may itself be a hole. In alternative embodiments, holder 88 may be an aperture, gap, tab, protrusion or other configuration capable of holding an end of a flexible tube. The opening 87 of the insert 100 may facilitate operable arrangement with or connection to the fluid output device that may allow users to withdraw liquid, or other fluids, from chamber 50 without having to remove insert 100 from the cooler.

Embodiments of first portion 60 may also include a closable opening 89 on a back surface 64 of the insert 100. In alternative embodiments, closable opening 89 may be located on bottom surface 24, side surface 63 or side surface 22 of the insert 100. Closeable opening 89 may be in fluid communication with chamber 50. Closable opening 89 may provide a method by which to drain a liquid or other flowable contents form chamber 50. In alternative embodiments, insert 100 may include either a siphon aperture or a closable opening 89 or neither a siphon aperture nor a closable opening 89.

Embodiments of first portion 60 may include a cavity 42. Embodiments of cavity 42 may comprise an indentation, a recessed portion, a cavity, a gap, or a hole in first portion 60 of the insert 100 that may function as a handle to carry the insert 100. Specifically, cavity 42 may be formed by creating an indentation or cavity in front surface 62 that extends into the first portion 60 toward the back surface 64. The cavity 42 of insert 100 may allow for convenient carrying of the insert 100 because a user may extend a hand within the cavity 42 to grip the insert 100. In some embodiments, cavity 42 may allow the insert 100 to more easily be placed into and removed from the cooler. In alternative embodiments, a cavity could be formed in side surface 63. Alternatively, a handle may be secured or otherwise attached to the insert 100. For example, a flexible material or a firm handle may be affixed to the first portion 60, such as on the top surface 61. Other embodiments may include manufacturing the insert 100 to have a handle as part of a one-piece insert.

Referring still to FIGS. 1-5, embodiments of the insert 100 may include a second portion 20. In some embodiments, first portion 60 may be in contact with and extend up from second portion 20. In some embodiments, second portion 20 may comprise a top surface 21, side surface 22, bottom surface 24, and end surface 23. Top surface 21 may include a curved portion 55. In some embodiments, top surface 21 may be connected to front surface 62 through curved surface 55. Top surface 21, side surface 22, bottom surface 24, and end surface 23 may have curved edges 25. In some embodiments, curved edges may allow the insert to fit more securely in a cooler and/or allow easier insertion and removal of the insert 100 in and out of the cooler. Additionally, in some embodiments, curved edges 25 may enhance the circulation of air in the cooler. In alternative embodiments, top surface 21, side surface 22, bottom surface 24, and end surface 23 may have beveled, chamfered or flat edges. Side surface 22 may be the same for both sides of the insert 100.

Embodiments of top surface 21 may include a plurality of projections 30. Projections 30 may extend along top surface 21 toward fourth end 14 and third end 13. Projections 30 may be continuous ribs having a half round shape. In some embodiments, projections 30 may be configured to be continuous with projections 70 on front surface 62. In alternative embodiments, projections 30 may have a triangular, chamfered, square or rectangular shape. And in further alternative embodiments, projections 30 may be segmented. Embodiments of projections 30 may include tapered ends 31 at third end 13. Alternatively, projections 30 may have tapered ends at both ends or no tapered ends at all. In alternative embodiments, projections 30 may be configured to extend across top surface 21 in a direction substantially parallel to third end 13.

In alternative embodiments, projections 30 may comprise pads. The pads may have a gumdrop, square, conical, circular, pentagon, hexagon, octagon or star shape. In further embodiments, projections 30 may comprise solid fins. In additional embodiments, top surface 21 may comprise projections that extend inwardly (i.e., toward the interior of chamber 50) to form recessed channels or grooves. In some embodiments, the projections may be configured to be continuous with the projections on front surface 62. Alternatively, top surface 21 may comprise projections that extend inwardly to form recessed pads. The pads may have a gumdrop, square, triangular, circular, pentagon, hexagon, octagon or star shape. Projections on top surface 21 may allow cooler contents to be placed thereon without being contaminated with fluid in the cooler. In alternatively embodiments, top surface 21 may not have any projections.

Figure 5:
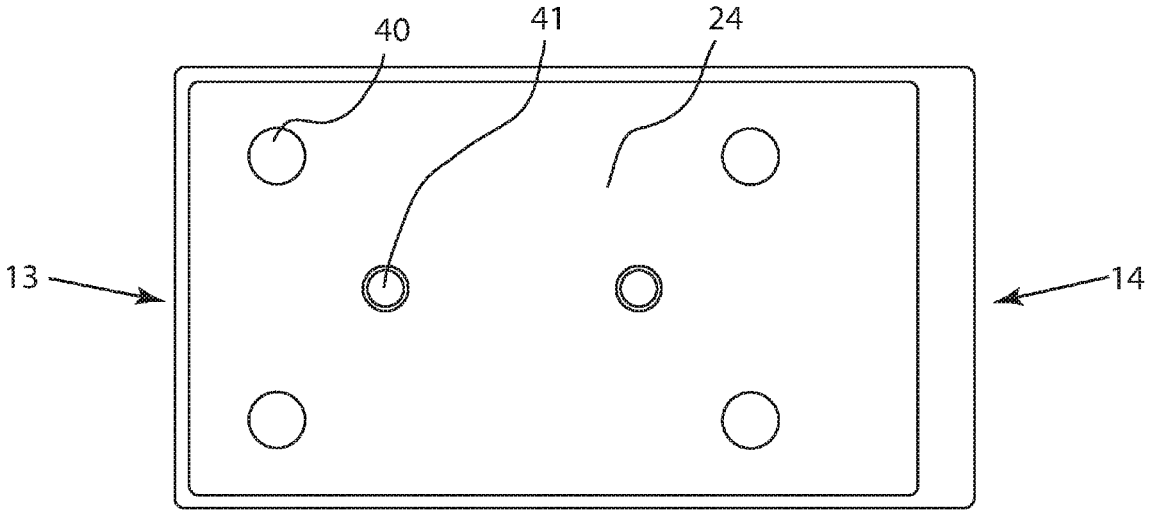
FIG. 5 depicts a bottom view of the first embodiment of the cooler insert.

Referring now to FIG. 5, embodiments of bottom surface 24 may comprise a plurality of projections 40. Projections 40 may comprise pads with a spherical shape. In alternative embodiments, projections 40 may be gumdrop, square, circular, pentagon, hexagon, octagon or star shaped. In alternative embodiments, projections 40 may comprise elongated ribs. The ribs may be continuous or segmented. In further embodiments, the ribs may have a half round, triangular, chamfered, square or rectangular shape. For example, the projections may comprise four individual ribs of one to several inches long each. Alternatively, the projections may comprise two continuous ribs that extend along the entire surface of bottom surface 24. In some embodiments, projections 40 are used to increase air convention in the cooler thereby reducing the cooler's temperature gradient. In alternative embodiments, bottom surface 24 does not comprise any projections.

In one embodiment, bottom surface 24 may include four projections 40. In some embodiments, bottom surface 24 may also comprise two tack-offs 41. Tack-offs 41 may increase the load capacity of second portion 20 by allowing deformation around the tack-off, thereby reducing the stress on the insert. In alternative embodiments, insert 100 may include any number of tack-offs, or can include no tack-offs at all.

Figure 1E:
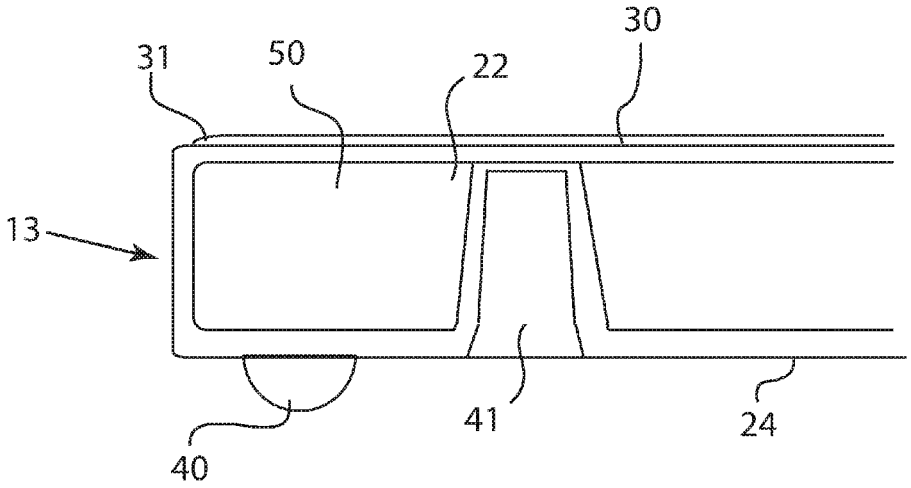
FIG. 1E depicts a detailed cross-sectional view of the first embodiment of the cooler insert.
Figure 1F:
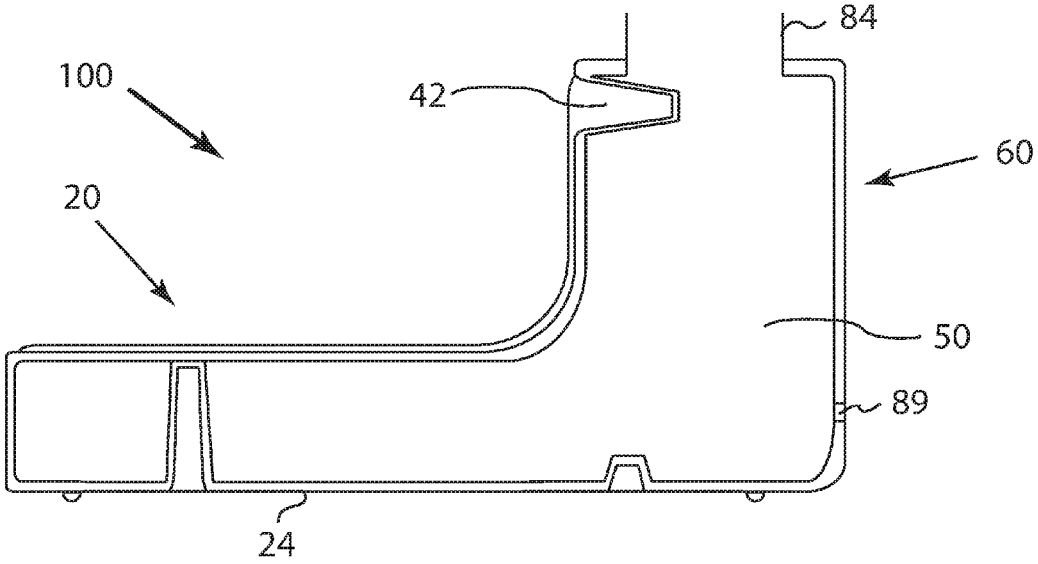
FIG. 1F depicts a cross-sectional view of the first embodiment of the cooler insert.
Figure 2:
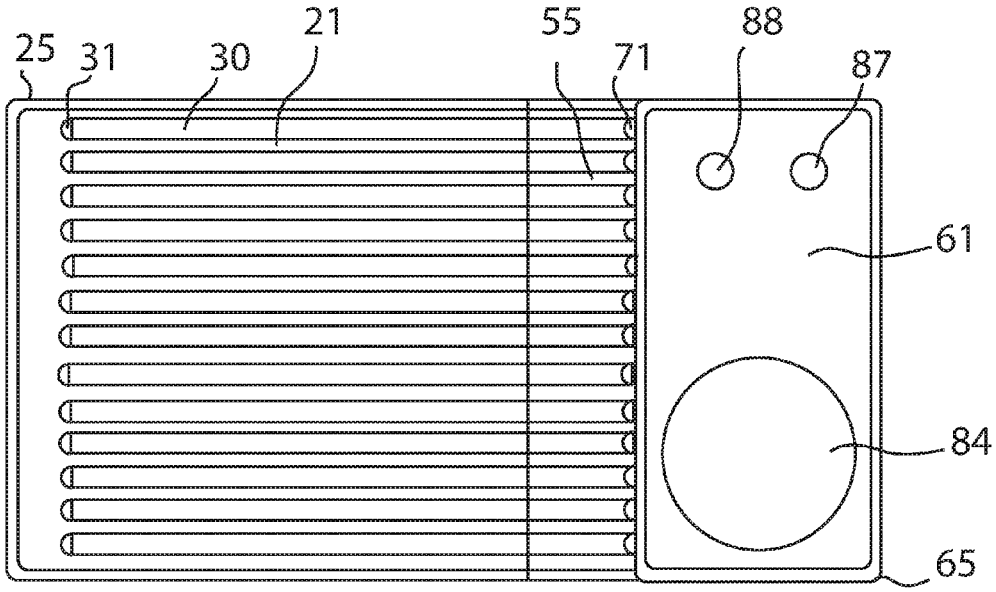
FIG. 2 depicts a top view of the first embodiment of the cooler insert.
Figure 3:
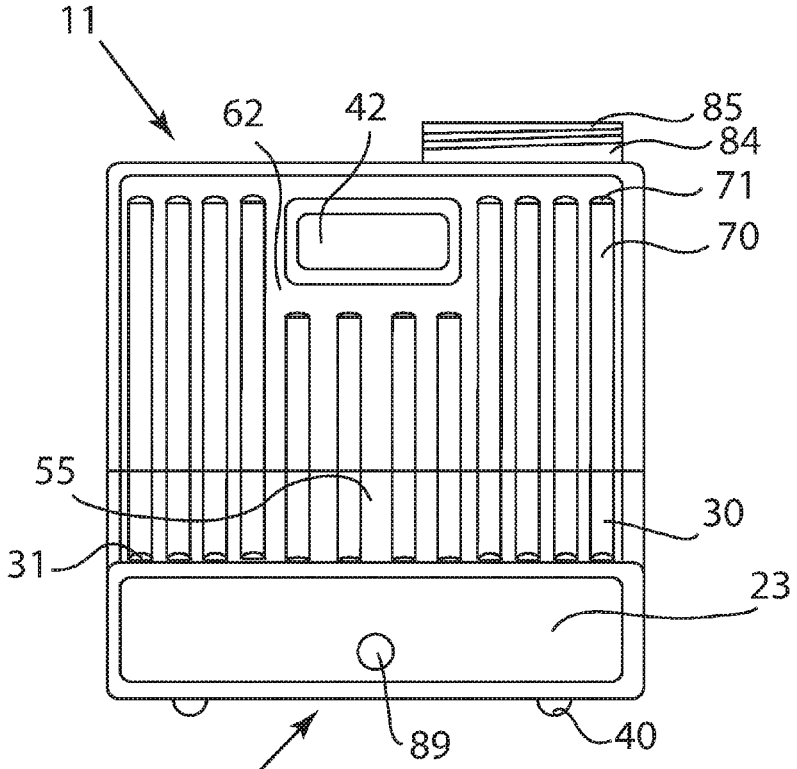
FIG. 3 depicts a front view of the first embodiment of the cooler insert.
Figure 4:
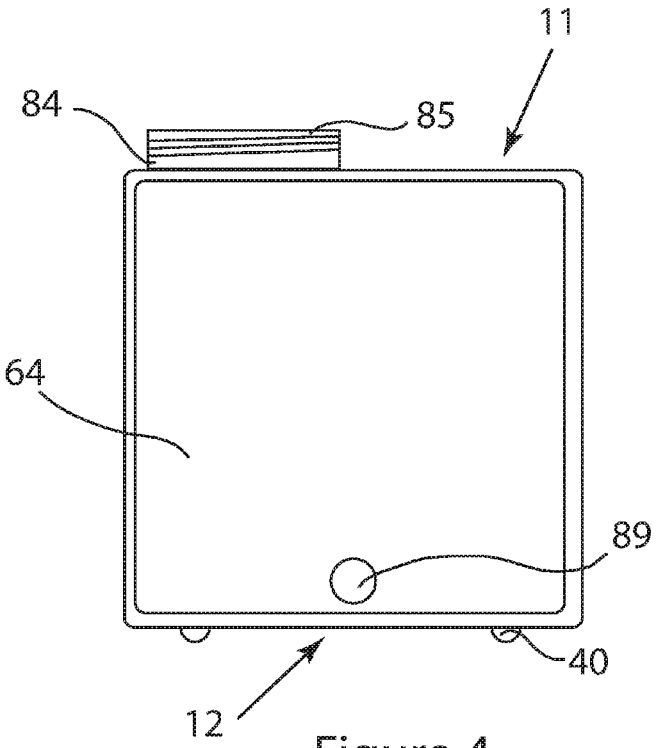
FIG. 4 depicts a back view of the first embodiment of the cooler insert.

Referring back to FIG. 1B, a close up cross sectional view of second portion 20 is depicted. In this embodiment, the tack-offs 41 have a gumdrop shape. In alternative embodiments, the tack-offs may be square, rectangular, cylindrical, pentagon, hexagon, octagon or star shaped. The tack-offs 41 may rise from a bottom surface 24 a distance towards an upper surface of the second portion 20. In the embodiments shown in FIG. 1*b*, the tack-off 41 does not reach the upper surface of the second portion 20. Referring to FIGS. 1E and 1F, embodiments of tack-offs 41 may reside proximate or touch the upper surface of the second portion 20. For instance, the tack-offs 41 may be fused with the upper surface of the second portion 20. In an exemplary embodiment, the tack-offs 41 may be part of an original mold that can be used to form the insert 100. The tack-offs 41 may provide additional support to the structure during the manufacturing process of the insert 100, as well as increase the load capacity of second portion 20 by allowing deformation around the tack-off 41, thereby reducing the stress on the insert 100, especially when contents are placed inside the cooler and onto the second portion 20 of the insert 100. The tack-offs 41 may also provide stability when freezing the insert 100; the tack-offs 41 may help prevent or hinder the distortion or bulging of the second portion 20 of the insert 100.

With reference now to FIGS. 1-5, embodiments of insert 100 may be a standalone component that is configured to be placed in a receptacle, such as a cooler or other container. The insert 100 may be dimensioned such that its mobility, when placed in the cooler, is substantially restricted. For example, bottom surface 24 may be dimensioned such that it extends securely between two opposing walls of a standard sized cooler. In further embodiments, bottom surface 24 may be dimensioned such that it extends securely between four walls of a standard sized cooler. In alternative embodiments, insert 100 may be fastened to the inside of a cooler. In some embodiments, the fastening agent may comprise a plastic weld or a chemical bonding agent such as glue. In alternative embodiments, the fastening agent may comprise tabular inserts, velcro, screws or nuts and bolts. Those having skill in the art should appreciate that embodiments of the insert 100 may be used in conjunction with a receptacle, cooler, or other container of any size, regardless of whether the insert 100 is sized and dimensioned to fit snugly within the container.

In some embodiments, back surface 64 and front surface 62 may extend along a cooler wall and bottom surface 24 and top surface 21 may extend along the cooler floor. Chamber 50 may reside in between back surface 64 and front surface 62 and bottom surface 24 and top surface 21. In some embodiments, chamber 50 may extend under top surface 21 and up along front surface 62 to inlet 84. Inlet 84 and opening 87 may be in fluid communication with chamber 50.

In use, chamber 50 may be substantially filled with ice and water, or just ice, through inlet 84 to affect, reduce, regulate, and/or manage a temperature within the receptacle housing the insert 100. Alternatively, water may be introduced into the chamber 50 via inlet 84, and the insert 100 may be stored in a freezer to freeze the insert 100 solid, to be inserted into a cooler. Moreover, items placed in the cooler may be placed on top surface 21 and may be further placed against front surface 62. Items placed within the receptacle may be cooled through a contact with top surface 21 and front surface 62. The items may also be simultaneously cooled by the air cooled by the presence of the insert 100 within the receptacle (e.g. cooler). In some embodiments, as ice placed in chamber 50 melts, ice may settle toward first end 11 in chamber 50 and water may settle near second end 12 of chamber 50. Cold melt water may travel down chamber 50 toward second end 12 forcing warmer water in chamber 50 to travel from second end 12 toward first end 11. Thus, the position of the melting ice in the insert may generate a circulating effect that reduces the temperature gradient in the cooler. Further, in some embodiments, the higher that back surface 64 extends up the adjacent cooler wall, the more the temperature gradient in the cooler may be reduced.

In some embodiments, in use, liquid may be removed from chamber 50 of insert 100 through opening 87. Liquid may be removed with a siphon, pump or other means as would be known to one of skill in the art. Ice may subsequently be added to chamber 50 through inlet 84 or, if removable, top surface 61. Thus, the cooler may be recharged by introducing ice or other cooling agents into the insert 100 without having to first remove the insert 100 from the cooler and/or the contents/items from the cooler. Further, only ice may be needed to recharge the cooler.

Figure 6A:
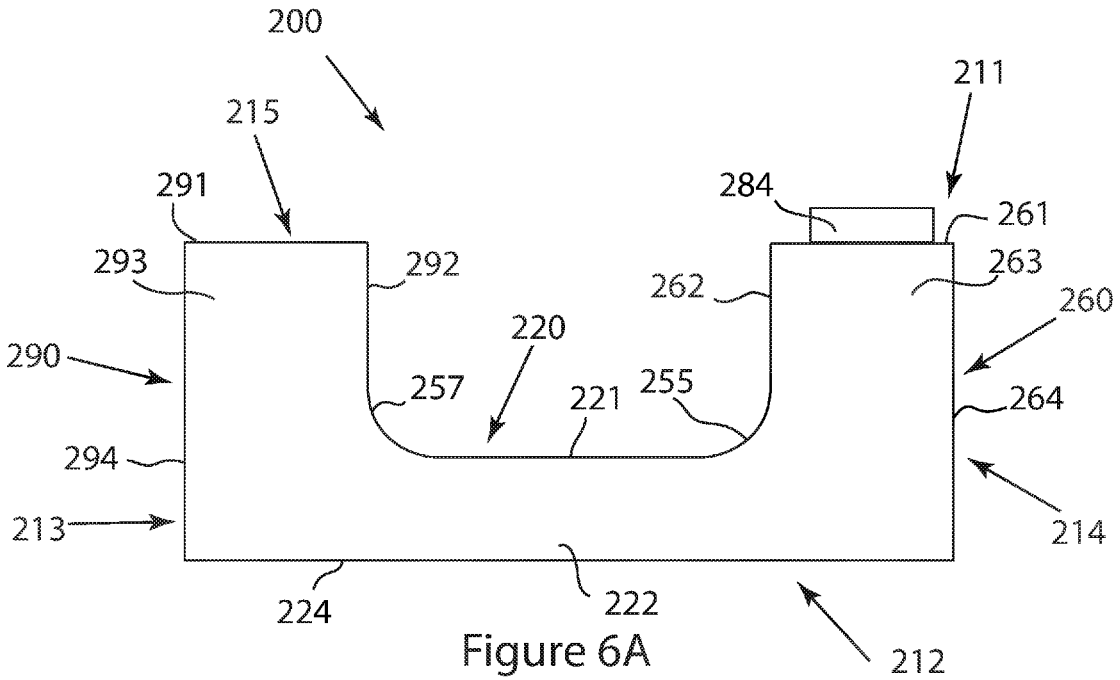
FIG. 6A depicts a side view of a second embodiment of a cooler insert.
Figure 6B:
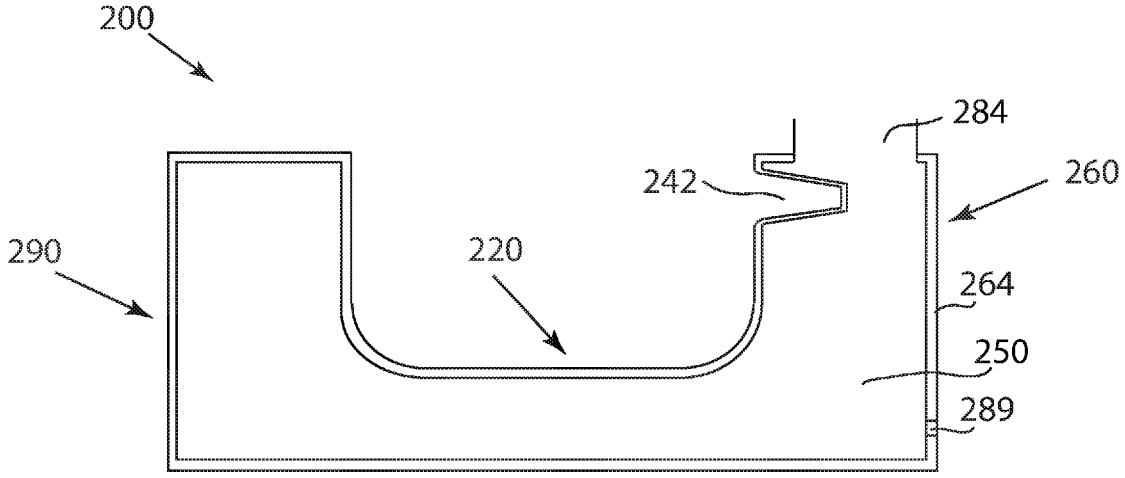
FIG. 6B depicts a cross-sectional side view of the second embodiment of the cooler insert.
Figure 7:
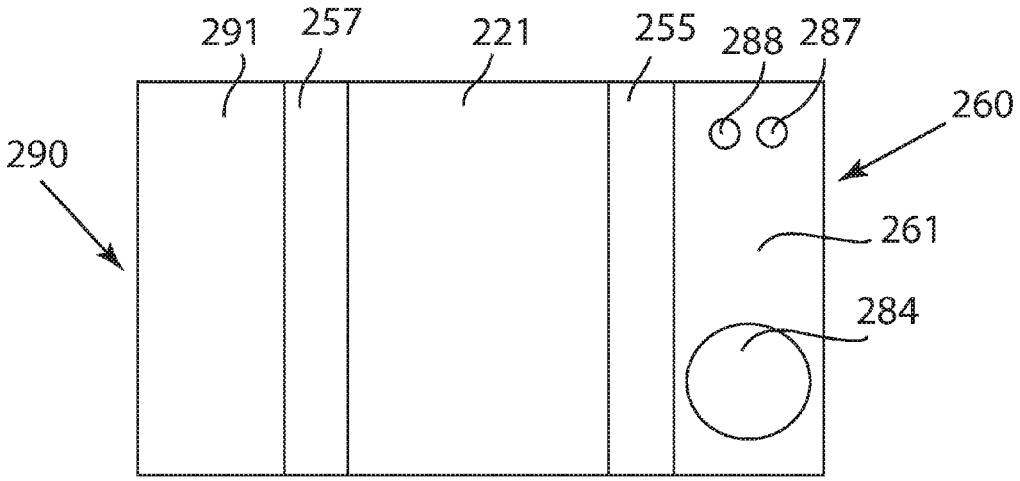
FIG. 7 depicts a top view of the second embodiment of the cooler insert.
Figure 8A:
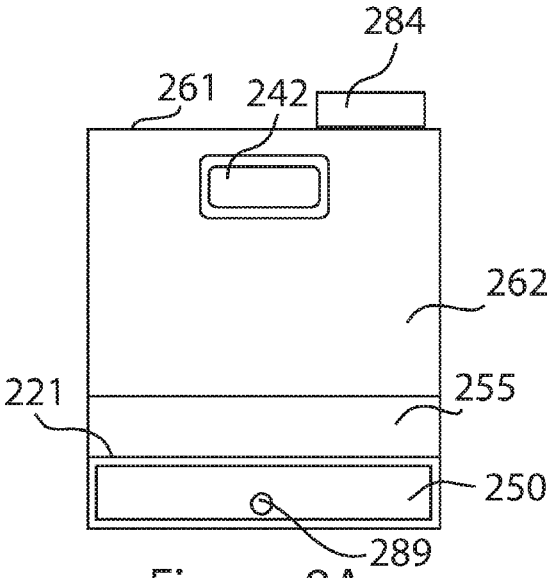
FIG. 8A depicts a cross-sectional front view of the second embodiment of the cooler insert.
Figure 8B:
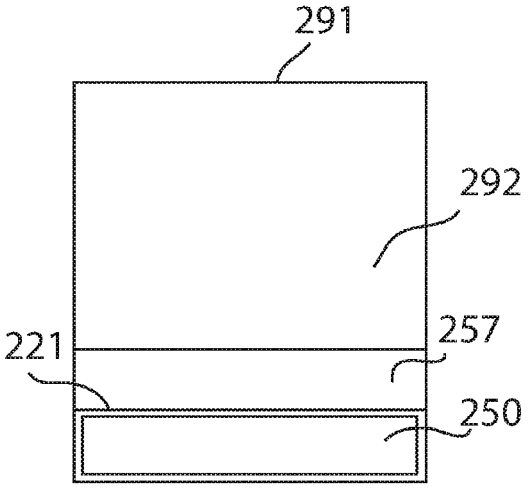
FIG. 8B depicts a second cross-sectional front view of the second embodiment of the cooler insert.
Figure 9:
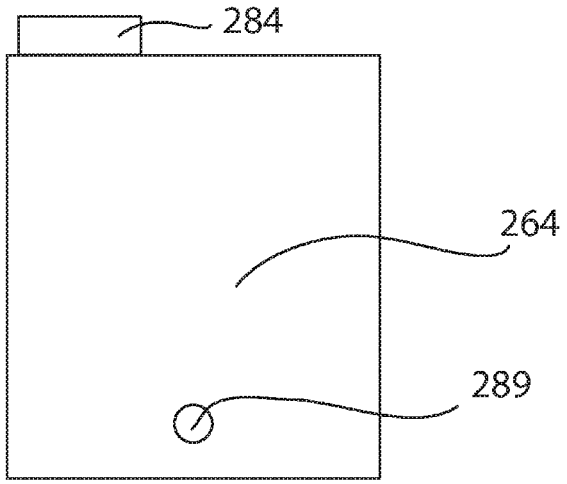
FIG. 9 depicts a back view of the second embodiment of the cooler insert.

Referring to the drawings, FIGS. 6A-6B depict an embodiment of insert 200. Embodiments of insert 200 may share the same or substantially the same structure and/or function as insert 100. For instance, embodiments of insert 200 may include a first portion 260, a second portion 220, and a chamber 350. However, embodiments of insert 200 may include a third portion 290. The first portion 260 and the third portion 290 may be connected to second portion 220 and may be configured to extend up therefrom. Chamber 250 may reside in first portion 260, second portion 220 and third portion 290. Chamber 250 may comprise a single cavity, internal volume or void, or multiple cavities, internal volumes or voids in fluid communication with one another. In some embodiments, chamber 250 is capable of holding a liquid.

In some embodiments, insert 200 may be manufactured in one piece, wherein the first portion 260, the second portion 220 and the third portion 290 are structurally integral. In alternative embodiments, insert 200 may be manufactured in sections. Embodiments of insert 200 may be manufactured by continuous extrusion blow molding, intermittent extrusion blow molding, rotational molding or injection blow molding, or other methods known to those having skill in the art. Insert 200 may be made from plastics or other pliable materials, such as rubber or comparable materials, and/or a combination thereof.

Referring now to FIGS. 6-9, embodiments of insert 200 may include a first portion 260. The first portion 260 may have a first end 211, a top surface 261, front surface 262, side surface 263 and a back surface 264. In some embodiments, top surface 261, front surface 262, side surface 263 and back surface 264 may have flat edges. In alternative embodiments, top surface 261, front surface 262, side surface 263 and back surface 264 may have curved, beveled or chamfered edges. In some embodiments, curved, beveled or chamfered edges may allow the insert to fit more securely in a cooler and/or allow easier insertion and removal of the insert 200 in and out of the cooler. Side surface 263 may be the same on both sides of the insert 200.

Embodiments of insert 200 may include a third portion 290. The third portion 290 may have a fifth end 215, a top surface 291, front surface 292, side surface 293 and a back surface 294. In some embodiments, top surface 291, front surface 292, side surface 293 and back surface 294 may have flat edges. In alternative embodiments, top surface 291, front surface 292, side surface 293 and back surface 294 may have curved, beveled or chamfered edges. In some embodiments, curved, beveled or chamfered edges may allow the insert to fit more securely in a cooler and/or allow easier insertion and removal of the insert 200 in and out of the cooler. Side surface 293 may be the same on both sides of the insert 200.

In embodiments of insert 200, front surface 262 and front surface 292 may not include any projections. In alternative embodiments, one or both of front surface 262 or front surface 292 may include a plurality of projections. For example, front surface 262 may include projections that extend between first end 211 and second end 212, and front surface 292 may include projections that extend between fifth end 215 and second end 212. The projections may be substantially similar to the projections described above with regard to insert 100. In some embodiments, projections on front surface 262 and front surface 292 may allow cooler contents to come into contact with portions of front surface 262 and front surface 292 without being contaminated with liquid that may have formed on other portions thereof. Further, in some embodiments, projections may facilitate the circulation of air in the cooler, which may reduce the temperature gradient across the cooler.

Embodiments of the insert 200 may further include an inlet 284. Inlet 284 may form part of the first portion 260 of the insert 200. For instance, embodiments of the inlet 284 may be disposed on the top surface 261 of the insert 200. Inlet 284 may be substantially similar to inlet 84 discussed above with regard to insert 100. In alternative embodiments, third portion 290 may have an inlet or third portion 290 and first portion 260 may have an inlet. In additional alternatives, neither first portion 260 nor third portion 290 have an inlet.

In alternative embodiments, access to the chamber 250 may be provided by partially or completely removing the top surface 261 from first portion 260. For example, the top surface 261 may be peeled back to create an opening to the chamber 250, and then laid back into a closed position. In some embodiments, top surface 261 may snap on and off of the first portion 260. Alternatively, top surface 261 may be hingedly connected to first portion 260 of the insert 200, thus allowing top surface 261 to be partially removed from first portion 260. Allowing top surface 261 to be partially or completely removable from first portion 60 may give users a larger area in which to add ice and/or liquid to chamber 250. In alternative embodiments, a portion of top surface 261 may be completely or partially removable. A partially or completely removable top surface 261 may also allow users to more easily access chamber 250, which may make cleaning insert 200 easier. In alternative embodiments, top surface 291 or a portion thereof may be partially or completely removable. In alternative embodiments, top surface 291 or a portion thereof and top surface 261 or a portion thereof may be partially or completely removable. In additional embodiments, neither top surface 291 nor top surface 261 are partially or completely removable.

Embodiments of top surface 261 may include an opening 287 and a holder 288. The opening 287 and the holder 288 may be substantially similar to the opening 87 and holder 88 discussed above with regard to insert 100. In alternative embodiments, top surface 291 or both top surface 261 and top surface 291 may include an opening and holder. In additional alternatives, neither top surface 261 nor top surface 291 may include an opening and holder.

Embodiments of first portion 260 may also include a closable opening 289 on a back surface 264 of the first portion 260 of the insert 200. In alternative embodiments, closable opening 289 may be located on bottom surface 224, back surface 294, side surface 293, side surface 263 or side surface 222. The closeable opening may be substantially similar to the closeable opening discussed above with regard to insert 100. In alternative embodiments, insert 200 may include either a siphon aperture or a closable opening 89 or neither a siphon aperture nor a closable opening 89.

Embodiments of first portion 260 may include a cavity 242. The cavity 242 may be substantially similar to the cavity 42 discussed above with regard to insert 100. Cavity 242 may be formed in front surface 262. In alternative embodiments, front surface 292 or both front surface 292 and front surface 262 may have a cavity. In alternative embodiments, a cavity could be formed in side surface 263 or 293. Alternatively, a handle may be secured or otherwise attached to the insert 200. For example, a flexible material or a firm handle may be affixed to the first portion 260 or third portion 290, such as on the top surface 261 or top surface 291. Other embodiments may include manufacturing the insert 200 to have a handle as part of a one-piece insert.

Referring still to FIGS. 6-9, embodiments of the insert 200 may include a second portion 220. In some embodiments, first portion 260 and third portion 290 may be in contact with and extend up from second portion 220. In some embodiments, second portion 220 may comprise a top surface 221, side surface 222 and bottom surface 224. Top surface 221 may include a curved portion 255 and curved portion 257. In some embodiments, top surface 221 may be connected to front surface 262 through curved surface 255, and top surface 221 may be connected to front surface 292 through curved surface 257. Top surface 221, side surface 222 and bottom surface 224 may have flat edges. In alternative embodiments, top surface 221, side surface 222 and bottom surface 224 may have curved, beveled or chamfered edges. In some embodiments, curved, beveled or chamfered edges may allow the insert to fit more securely in a cooler and/or allow easier insertion and removal of the insert 200 in and out of the cooler. Side surface 222 may be the same for both sides of insert 200.

In some embodiments, top surface 221 may not comprise any projections. In alternative embodiments, top surface 221 may include a plurality of projections. The projections may extend along top surface 221 toward fourth end 214 and third end 213. In alternative embodiments, the projections may extend in a direction that is substantially parallel to third end 213. The projections may be substantially similar to the projections discussed above with regard to insert 100.

In alternative embodiments, bottom surface 224 may comprise a plurality of projections. The projections may be substantially similar to the projections 40 discussed above with regard to insert 100. In additional alternatives, bottoms surface 224 may comprise one or more tack-offs. Tack-offs may increase the load capacity of second portion 220 by allowing deformation around the tack-off, thereby reducing the stress on the insert. The tack-offs may be substantially similar to the tack-offs discussed above with regard to insert 100.

In some embodiments, insert 200 may be a standalone component that is configured to be placed in a receptacle, such as a cooler or other container. The insert 200 may be dimensioned such that its mobility when placed in the cooler is substantially restricted. For example, bottom surface 224 may be dimensioned such that it extends securely between two opposing walls of a standard sized cooler. In further embodiments, bottom surface 224 may be dimensioned such that it extends securely between four walls of a standard sized cooler. In alternative embodiments, insert 200 may be fastened to the inside of a cooler. In some embodiments, the fastening agent may comprise a plastic weld, velcro or a chemical bonding agent such as glue. In alternative embodiments, the fastening agent may comprise tabular inserts, screws or nuts and bolts.

In some embodiments, back surface 264 and front surface 262 may extend along a first cooler wall, back surface 294 and front surface 292 may extend along a second cooler wall and bottom surface 224 and top surface 221 may extend along the cooler floor. Chamber 250 may reside in between back surface 264 and front surface 262, back surface 294 and front surface 292 and bottom surface 224 and top surface 221. In some embodiments, chamber 250 may extend under top surface 221 and up along front surface 262 to inlet 84. Chamber 250 may also extend up along front surface 292 to top surface 291. Inlet 284 and opening 287 may be in fluid communication with chamber 250. In use, chamber 250 may be substantially filled with ice and water through inlet 284 and/or removable top surface 291 to affect, reduce, regulate, and/or manage a temperature within the receptacle housing the insert 200. Moreover, items placed in the cooler may be placed on top surface 221 and may be further placed against front surface 262 and/or front surface 292. Items placed within the receptacle may be cooled through a contact with top surface 221, front surface 262 and front surface 292. The items may also be simultaneously cooled by the air cooled by the presence of the insert 100 within the receptacle (e.g. cooler). In some embodiments, as ice placed in chamber 250 melts, ice may settle toward first end 211 and fifth end 215 in chamber 250, and water may settle near second end 212 of chamber 250. Cold melt water may travel down chamber 250 toward second end 212 forcing warmer water in chamber 250 to travel from second end 212 toward first end 211 and fifth end 215. Thus, the position of the melting ice in the insert may generate a circulating effect that reduces the temperature gradient in the cooler. Further, in some embodiments, the higher that back surface 264 and/or back surface 294 extend up the adjacent cooler wall, the more the temperature gradient in the cooler may be reduced.

In some embodiments, in use, liquid may be removed from chamber 250 of insert 200 through opening 287. Liquid may be removed with a siphon, pump or other means as would be known to one of skill in the art. Ice may subsequently be added to chamber 250 through inlet 284 or, if removable, top surface 261 or top surface 291. Thus, the cooler may be recharged by introducing ice or other cooling agents into the insert 200 without having to first remove the insert 100 from the cooler and/or the contents/items from the cooler. Further, only ice may be needed to recharge the cooler.

Figure 10:
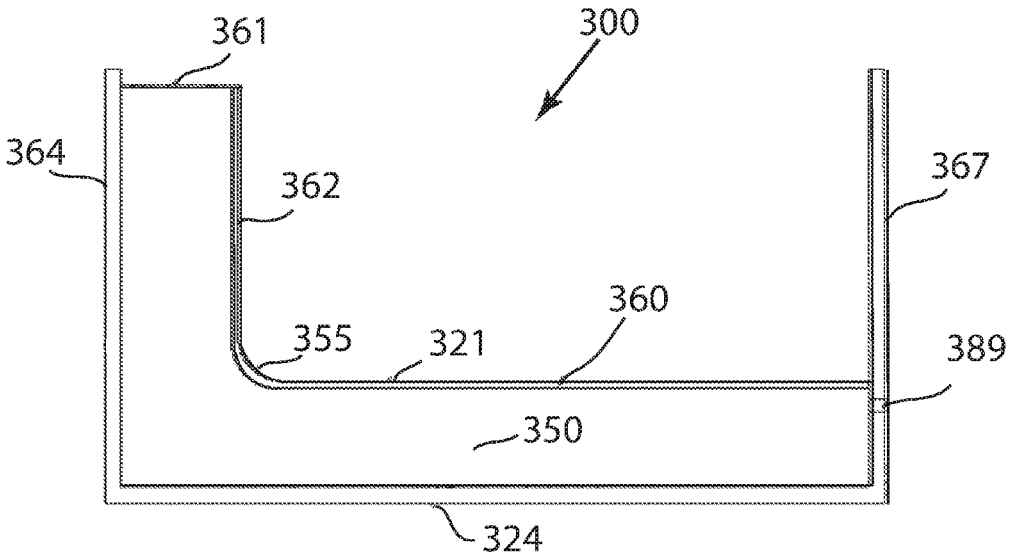
FIG. 10 depicts a cross-sectional side view of a first embodiment of a cooler.
Figure 11:
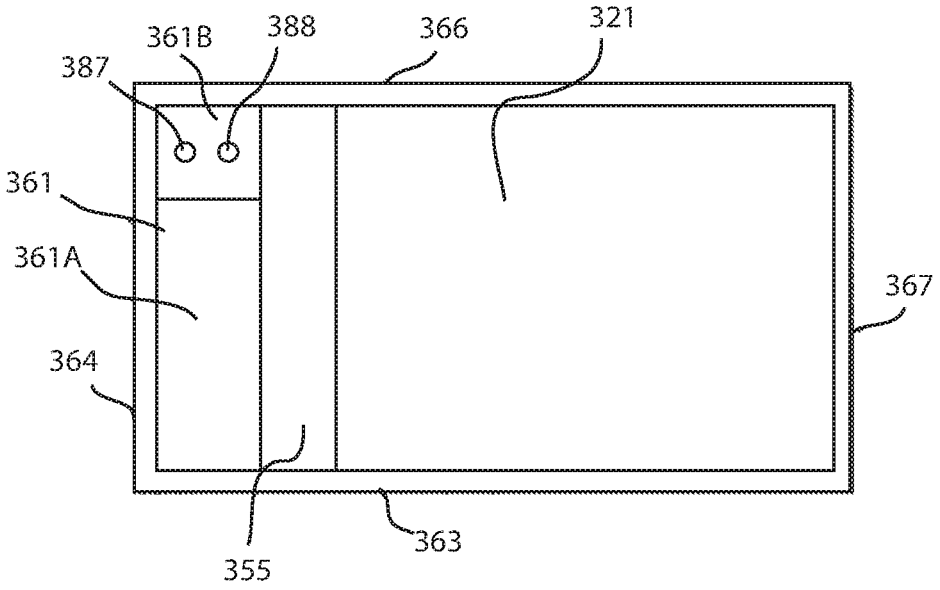
FIG. 11 depicts a top view of the first embodiment of the cooler.
Figure 12:
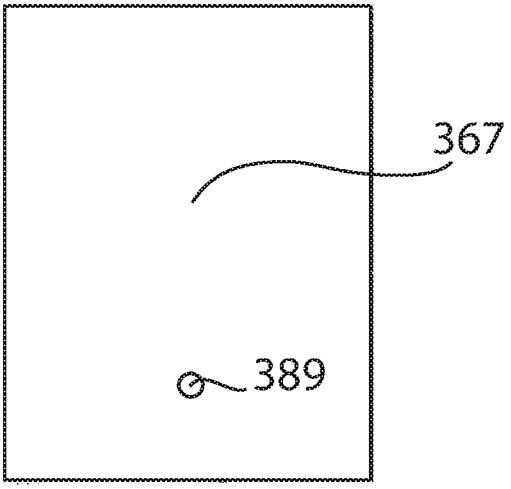
FIG. 12 depicts an end view of the first embodiment of the cooler.

With continued reference to the drawings, FIG. 10-12 depict an embodiment of a cooler 300. Embodiments of cooler 300 may be a container, a receptacle, a housing, an openable enclosure, and the like. Embodiments of the cooler 300 may be a temperature regulator, a temperature regulator device, a temperature controller, a temperature controller device, a temperature management device, or any device that affect or reduce a temperature within its interior and capable of storing and/or accepting contents. Embodiments of cooler 300 may include a plurality of walls, such as a first wall 364, a second wall 367, a third wall 366, a fourth wall 363, a floor 324, a partition 360, and a chamber 350. In some embodiments, partition 360 may comprise a top surface 321, front surface 362 and top surface 361. In some embodiments, chamber 350 may reside between front surface 362 of partition 360 and wall 364 and top surface 321 of partition 360 and cooler floor 324. Chamber 350 may comprise a single cavity, internal volume or void, or multiple cavities, internal volumes or voids in fluid communication with one another. In some embodiments, chamber 350 may be capable of holding a liquid.

In some embodiments, the plurality of walls, floor and partition may be manufactured in one piece, wherein the walls, floor and partition are structurally integral. In alternative embodiments, cooler 300 may be manufactured in sections. Embodiments of cooler 300 may be manufactured by continuous extrusion blow molding, intermittent extrusion blow molding, rotational molding or injection blow molding, or other methods known to those having skill in the art. Cooler 300 may be made from plastics or other pliable materials, such as rubber or comparable materials, and/or a combination thereof.

In some embodiments, top surface 321 may comprise curved portion 355, and top surface 321 may be connected to front surface 362 through curved portion 355. In alternative embodiments, one or more additional walls, surfaces or the floor may include a curved portion. In further alternatives, the surfaces, walls and floor may be substantially flat.

Embodiments of top surface 361 may include a removable portion 361A and fixed portion 361B. Removable portion 361A may be completely removable or partially removable. For example, removable portion 361A may be peeled back to create an opening to the chamber 350, and then laid back into a closed position. In some embodiments, removable portion 361A may snap on an off of insert 300. Alternatively, removable portion 361A may be hingedly connected to insert 300, thus allowing removable portion 361A to be partially removed from insert 300. Allowing removable portion 361A to be partially or completely removable from insert 300 may give users a larger area in which to add ice and/or liquid to chamber 350. A partially or completely removable portion 361A may allow users to more easily access chamber 350, which may make cleaning insert 300 easier. In alternative embodiments, top surface 361 may not include a removable portion, but may itself be completely or partially removable. In alternative embodiments, top surface 361 may not be removable. In some embodiments, top surface 361 may include an inlet.

Embodiments of top surface 361 may include an opening 387 and a holder 388. Opening 387 and holder 388 may be located on fixed portion 361B. In alternative embodiments, opening 387 and holder 388 may be located on removable portion 361A. Opening 387 and holder 388 may be substantially the same as opening 87 and holder 88 discussed above in regards to insert 100.

In alternative embodiments, one or more of front surface 362 and top surface 321 may include a plurality of projections. The projections may be substantially similar to the projections discussed above with regard to insert 100. In alternative embodiments, front surface 362 and top surface 321 may not include any projections.

In some embodiments, wall 367 may include a closeable opening 389. Closeable opening 389 may allow users to remove water from cooler 300 without having to remove contents placed therein. In alternative embodiments, closeable opening 389 may be located in floor 324, or wall 364, 366 or 363. In alternative embodiments, cooler 300 may not include a closeable opening 389.

Figure 13:
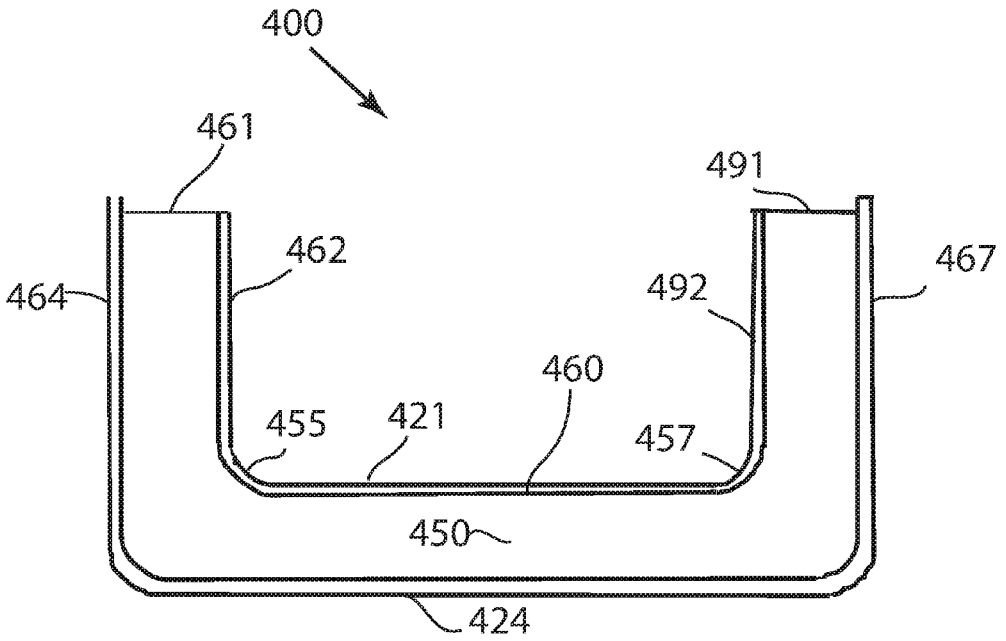
FIG. 13 depicts a side view of a second embodiment of a cooler.
Figure 14:
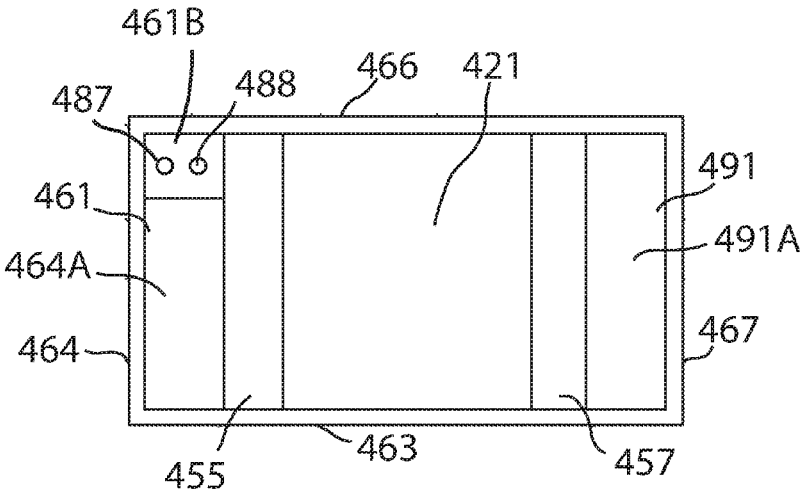
FIG. 14 depicts a top view of the second embodiment of the cooler.

FIGS. 13-15 depict an embodiment of cooler 400. Embodiments of cooler 400 may share the same or substantially the same structure and/or function as cooler 300. For instance, embodiments of cooler 400 include a first wall 464, a second wall 467, a third wall 466, a fourth wall 463, a floor 424, a partition 460, and a chamber 450. Partition 460 may include a top surface 461, front surface 462, top surface 421, front surface 492 and top surface 491. Chamber 450 may reside between front surface 462 of partition 460 and wall 464, and top surface 421 of partition 460 and cooler floor 424, and front surface 492 of partition 460 and wall 467. Chamber 450 may comprise a single cavity, internal volume or void, or multiple cavities, internal volumes or voids in fluid communication with one another. In some embodiments, chamber 450 may be capable of holding a liquid.

In some embodiments, the plurality of walls, floor and partition may be manufactured in one piece, wherein the walls, floor and partition are structurally integral. In alternative embodiments, cooler 400 may be manufactured in sections. Embodiments of cooler 400 may be manufactured by continuous extrusion blow molding, intermittent extrusion blow molding, rotational molding or injection blow molding, or other methods known to those having skill in the art. Cooler 400 may be made from plastics or other pliable materials, such as rubber or comparable materials, and/or a combination thereof.

In some embodiments, top surface 421 may comprise curved portion 457 and curved portion 455. Top surface 421 may contact front surface 492 through curved portion 457, and top surface 421 may contact front surface 462 through curved portion 455. In alternative embodiments, one or more additional walls, surfaces or the floor may include a curved portion. In further alternatives, the surfaces, walls and floor may be substantially flat.

Embodiments of top surface 461 may include a removable portion 461A and fixed portion 461B. Removable portion 461A may be substantially the same as removable portion 361A discussed above with regard to insert 300. In alternative embodiments, top surface 461 may not include a removable portion, but may itself be completely or partially removable. In alternative embodiments, top surface 461 may not be removable. In some embodiments, top surface 461 may include an inlet. In alternative embodiments, top surface 491 may also include a completely or partially removable portion. Alternatively, top surface 491 may be completely or partially removable itself or may not be removable at all. In additional embodiments, top surface 491 may include an inlet.

In alternative embodiments, one or more of front surface 462, top surface 421, and front surface 492 may include a plurality of projections. The projections may be substantially similar to the projections discussed above with regard to insert 100.

Fabrication of the insert and cooler together may allow users to maximize the volume in which they can store items while obtaining the benefits of the insert described above.

The present invention is disclosed above by preferred embodiments. However, persons skilled in the art should understand that the preferred embodiments are illustrative of the present invention only, and should not be interpreted as restrictive of the scope of the present invention. Hence, all equivalent modification and replacements made to the aforesaid embodiments should fall within the scope of the present invention. Accordingly, the legal protection for the present invention should be defined by the appended claims.

The invention claimed is:

1. An insertable cooling device configured to be disposed in a receptacle for receiving contents, the insertable cooling device comprising: a first portion having an opening for inserting cold contents into the insertable cooling device, the first portion including a plurality of ribs, the plurality of ribs forming a channel between each of the plurality of ribs; and a second portion connected to the first portion, the second portion having a plurality of tack-offs on a bottom surface, wherein the plurality of tack-offs increase a load capacity of the second portion by allowing a deformation around the plurality of tack-offs, thereby reducing a stress on the second portion, which accommodates at least one food and beverage contents; wherein the cold contents inserted through the opening of the first portion are located within an interior of the insertable cooling device to deliver refrigeration to an interior of the receptacle, such that cool air from the insertable cooling source circulates within the interior of the receptacle above and below the insertable cooling source.

2. The insertable cooling source of claim 1, wherein the first portion is configured to extend across at least a portion of a side surface of the receptacle.

3. The insertable cooling source of claim 1, wherein the cool air circulates between the plurality of ribs in the channels underneath the contents placed onto the platform, and a between a plurality of ribs located on a rear surface.

4. The insertable cooling source of claim 1, wherein the first portion and the second portion are formed as an integral structure.

5. The insertable cooling source of claim 1, further comprising:

an indentation in the first portion that is configured to be used as a handle.

6. The insertable cooling device of claim 1, further comprising: a third portion, the third portion including a third plurality of projections configured to extend across at least a portion of the side surface of the receptacle and face the first plurality of projections.

7. An insert configured to be disposed in a cooler, the insert comprising:

a bottom surface, the bottom surface having a plurality of feet configured to engage an interior floor surface of the cooler, the plurality of feet creating a space between the bottom surface and the interior floor surface of the cooler to allow cool air from the insert to pass therebetween;

a back surface residing proximate a first side wall of the cooler when the insert is disposed within the cooler, the back surface including a plurality of projections on both a front side and a back side;

a cooling surface having a top end and a bottom end, the cooling surface including a plurality of ribs continuously extending from the top end to the bottom end, wherein a portion of the plurality of ribs form a platform for receiving contents placed within the cooler, the portion of the plurality of ribs being parallel to the interior floor surface of the cooler; and a plurality of tack-offs, the plurality of tack-offs increasing a load capacity of the insert by allowing a deformation around the plurality of tack-offs, thereby reducing a stress on the cooling surface.

8. The insert of claim 7, wherein the insert is integrally formed as a single component to be placed within the cooler.

9. The insert of claim 7, wherein the opening includes a threaded surface for threadably securing a lid to cover an opening.

10. The insert of claim 7, wherein cool air circulates in a plurality of channels between the plurality of ribs underneath the contents placed onto the platform.

11. The insert of claim 10, further comprising: an integral handle formed by an indentation of the cooling surface located proximate the top end of the cooling surface also indicates the maximum fill line for cold contents.

* * * * *